US010017967B2

(12) United States Patent
Vazquez et al.

(10) Patent No.: US 10,017,967 B2
(45) Date of Patent: Jul. 10, 2018

(54) APPARATUS AND METHOD FOR HOLD OPEN FEATURE IN A LATCH

(71) Applicants: Francisco Javier Vazquez, Chihuahua (MX); Alfredo Martinez, Chihuahua (MX); Donald Michael Perkins, Sterling Heights, MI (US)

(72) Inventors: Francisco Javier Vazquez, Chihuahua (MX); Alfredo Martinez, Chihuahua (MX); Donald Michael Perkins, Sterling Heights, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 636 days.

(21) Appl. No.: 14/339,619

(22) Filed: Jul. 24, 2014

(65) Prior Publication Data

US 2015/0028603 A1 Jan. 29, 2015

Related U.S. Application Data

(60) Provisional application No. 61/859,114, filed on Jul. 26, 2013.

(51) Int. Cl.
*E05C 3/06* (2006.01)
*E05B 81/06* (2014.01)
(Continued)

(52) U.S. Cl.
CPC ..... *E05B 81/06* (2013.01); *E05B 81/15* (2013.01); *E05B 81/32* (2013.01); *E05B 81/34* (2013.01); *Y10T 292/108* (2015.04)

(58) Field of Classification Search
CPC ..... E05B 81/06; E05B 81/15; E05B 81/32; E05B 81/34; E05B 81/00; E05B 81/04;
(Continued)

(56) References Cited

U.S. PATENT DOCUMENTS 3,969,789 A 7/1976 Wize
6,568,741 B1 5/2003 Leung et al.
(Continued)

FOREIGN PATENT DOCUMENTS

CN 101736962 A 6/2010
CN 201963080 U 9/2011
(Continued)

OTHER PUBLICATIONS

Computer Generated Translation for DE 10312093, Generated on Jun. 20, 2017, http://ptoweb.uspto.gov/ptointranet/index.htm.*
(Continued)

*Primary Examiner* — Alyson M Merlino
(74) *Attorney, Agent, or Firm* — Cantor Colburn LLP

(57) ABSTRACT

A latch is disclosed herein. The latch having: a fork bolt movably mounted to the latch for movement between an open position and a closed position; a detent lever movably mounted to the latch for movement between a latched position and a released position, wherein the detent lever prevents the fork bolt from moving from the closed position to the open position when the detent lever is in the latched position; a bellcrank lever movably mounted to the latch for movement between a first position and a second position, wherein the bellcrank lever moves the detent lever from the latched position to the released position as the bellcrank lever moves from the first position to the second position; and a hold open feature movably mounted to the latch for movement between a first position and a second position, wherein the hold open feature is configured to engage and retain the bellcrank lever in the second position when the hold open feature is in the first position and wherein the hold open feature allows the bell crank lever to travel from the second position to the first position when the hold open feature is in the second position.

20 Claims, 14 Drawing Sheets

(51) Int. Cl.

| | |
|---|---|
| ***E05B 81/34*** | (2014.01) |
| ***E05B 81/14*** | (2014.01) |
| ***E05B 81/32*** | (2014.01) |
| *E05C 3/16* | (2006.01) |

(58) Field of Classification Search
CPC ..... E05B 81/14; E05B 81/16; E05B 81/18; E05B 81/42; E05B 83/16; E05B 83/18
USPC ..... 292/201, 216, DIG. 23
See application file for complete search history.

(56) References Cited

U.S. PATENT DOCUMENTS

| | | | | |
|---|---|---|---|---|
| 6,575,507 | B2 * | 6/2003 | Reddmann | E05B 81/14 292/201 |
| 6,679,531 | B2 | 1/2004 | Rogers, Jr. et al. | |
| 6,817,636 | B1 * | 11/2004 | Evans | E05B 81/14 292/201 |
| 8,348,310 | B2 | 1/2013 | Vazquez et al. | |
| 2003/0038485 | A1 * | 2/2003 | Schwaiger | E05B 81/14 292/201 |
| 2005/0167990 | A1 * | 8/2005 | Orzech | E05B 81/14 292/201 |
| 2010/0127512 | A1 | 5/2010 | Vazquez et al. | |
| 2010/0171320 | A1 * | 7/2010 | Cumbo | E05B 81/14 292/200 |
| 2011/0074166 | A1 * | 3/2011 | Taurasi | E05B 81/14 292/27 |
| 2011/0204659 | A1 | 8/2011 | Estrada et al. | |
| 2012/0175896 | A1 * | 7/2012 | Martinez | E05B 81/06 292/199 |
| 2012/0292927 | A1 | 11/2012 | Vazquez et al. | |
| 2013/0015670 | A1 | 1/2013 | Perkins | |
| 2013/0161961 | A1 | 6/2013 | Burciaga et al. | |
| 2014/0292000 | A1 | 10/2014 | Vazquez et al. | |

FOREIGN PATENT DOCUMENTS

| | | | | |
|---|---|---|---|---|
| CN | 102858566 | A | 1/2013 | |
| CN | 102877717 | A | 1/2013 | |
| DE | 10312093 | A1 * | 3/2004 | E05B 81/14 |
| DE | 202010007179 | U1 | 9/2011 | |
| JP | 2008530407 | A | 8/2008 | |
| WO | 2006087578 | A1 | 8/2006 | |

OTHER PUBLICATIONS

Computer Generated Translation for CN 101736962 A, Generated on Oct. 30, 2017, https://worldwide.espacenet.com/ (Year: 2017).*
Chinese Office Action for Patent Application No. 201410360856.X; dated Apr. 13, 2016; 11 pgs.
Chinese Search Report for Patent Application No.: 201410360856.X; dated Mar. 31, 2016; 2 pgs.
English Abstract for CN101736962A—Jun. 16, 2010; 2 pgs.
English Abstract for CN102858566A—Jan. 2, 2013; 2 pgs.
English Abstract for CN102877717A—Jan. 16, 2013; 1 pg.
English Abstract for CN201963080U—Sep. 7, 2011; 1 pg.
English Abstract for DE202010007179U1—Sep. 8, 2011; 1 pg.
English Abstract for JP2008530407A—Aug. 7, 2008; 2 pgs.
English Translation of Chinese Office Action for Patent Application No. 201410360856.X; dated Apr. 13, 2016; 11 pgs.

* cited by examiner

APPARATUS AND METHOD FOR HOLD OPEN FEATURE IN A LATCH

CROSS REFERENCE TO RELATED APPLICATIONS

This application claims the benefit of U.S. Provisional Patent Application Ser. No. 61/859,114 filed Jul. 26, 2013, the contents of which are incorporated herein by reference thereto.

BACKGROUND

Certain passenger vehicles are equipped with a rear vehicle storage compartment, commonly known as a trunk. The trunk is closed by a deck lid that is hinged to the vehicle body and swings open to provide access to the storage compartment. Similarly, other vehicles are equipped with a lift gate that allows access to the rear of the vehicle through a gate that is hinged at or near the roof line of a vehicle and opens upward. Other vehicles have sliding doors that run horizontally on a track between an opened and closed position. Each of the deck lid, lift gate or sliding door can be thought of as panels that allow access to the interior of the vehicle compartment. Compartment latches, enable each of these types of panels to be secured and closed.

When it is desired to open these panels, it is known to use a remote unlatch mechanism that releases a detent lever from engagement with a fork bolt, allowing a striker pin to be removed from the catch (or throat) of the fork bolt. Advantageously, the deck lid, lift gate or sliding door will release from the striker pin and bias away from the striker due to shocks, springs, motors etc. incorporated in these panels. However, when the panel does not bias away, the remote unlatch mechanism that causes the detent lever to be released from engagement with the fork bolt is de-energized. As a result, the detent lever risks falling back into engagement with the fork bolt and the panel cannot be opened. When the panel does not automatically bias open upon release of the detent lever from the fork bolt, it would be advantageous to maintain the detent lever in a released position until such time as the panel can be manually opened.

Thus, it is also desirable to provide an apparatus, or feature or method of operation that prevents the latch from operating or being positioned in a configuration that is inconsistent with an intended operation of the latch.

SUMMARY OF THE INVENTION

In one non-limiting embodiment, a latch is provided. The latch having: a fork bolt movably mounted to the latch for movement between an open position and a closed position; a detent lever movably mounted to the latch for movement between a latched position and a released position, wherein the detent lever prevents the fork bolt from moving from the closed position to the open position when the detent lever is in the latched position; a bellcrank lever movably mounted to the latch for movement between a first position and a second position, wherein the bellcrank lever moves the detent lever from the latched position to the released position as the bellcrank lever moves from the first position to the second position; and a hold open feature movably mounted to the latch for movement between a first position and a second position, wherein the hold open feature is configured to engage and retain the bellcrank lever in the second position when the hold open feature is in the first position and wherein the hold open feature allows the bell crank lever to travel from the second position to the first position when the hold open feature is in the second position.

In another non-limiting embodiment, a method of disengaging a hold open feature from engagement with a detent lever of a latch, is provided. The method including the steps of: pivotally mounting a fork bolt to the latch for movement between an open position and a closed position; pivotally mounting the detent lever to the latch for movement between a latched position and a released position, wherein the detent lever engages the fork bolt and prevents the fork bolt from moving from the closed position to the open position when the detent lever is in the latched position; movably mounting a bellcrank lever to the latch for movement between a first position and a second position, wherein the bellcrank lever is configured to engage move the detent lever from the latched position to the released position as it moves from the first position to the second position; and movably mounting a hold open feature to the latch for movement between a first position and a second position, wherein the hold open feature is configured to engage and retain the bellcrank lever in the second position when the hold open feature is in the first position and wherein the hold open feature allows the bell crank lever to travel from the second position to the first position when the hold open feature is in the second position.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
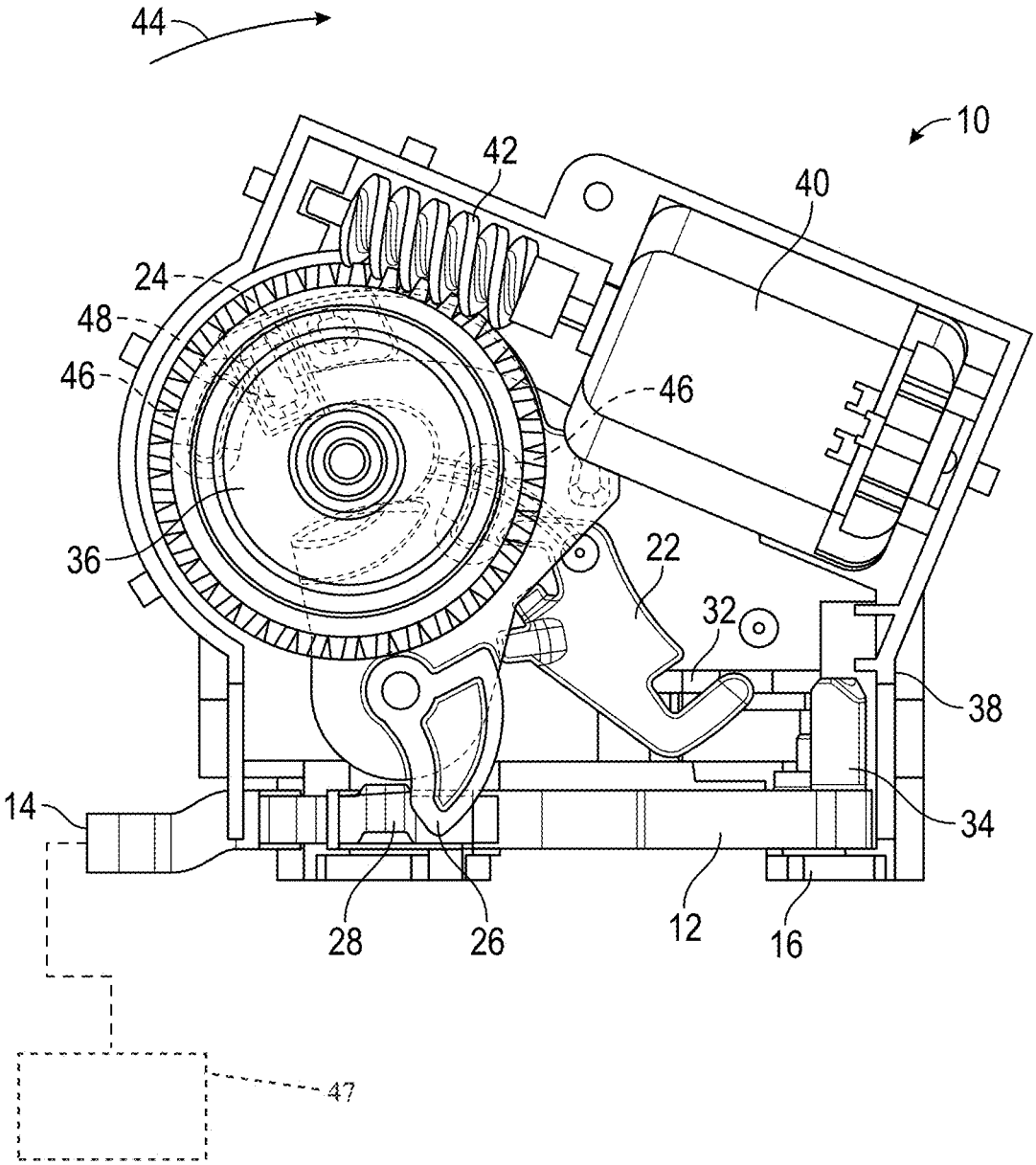
FIG. 1 illustrates a non-limiting embodiment of a latch in a primary or latched position to an open position.
Figure 2:
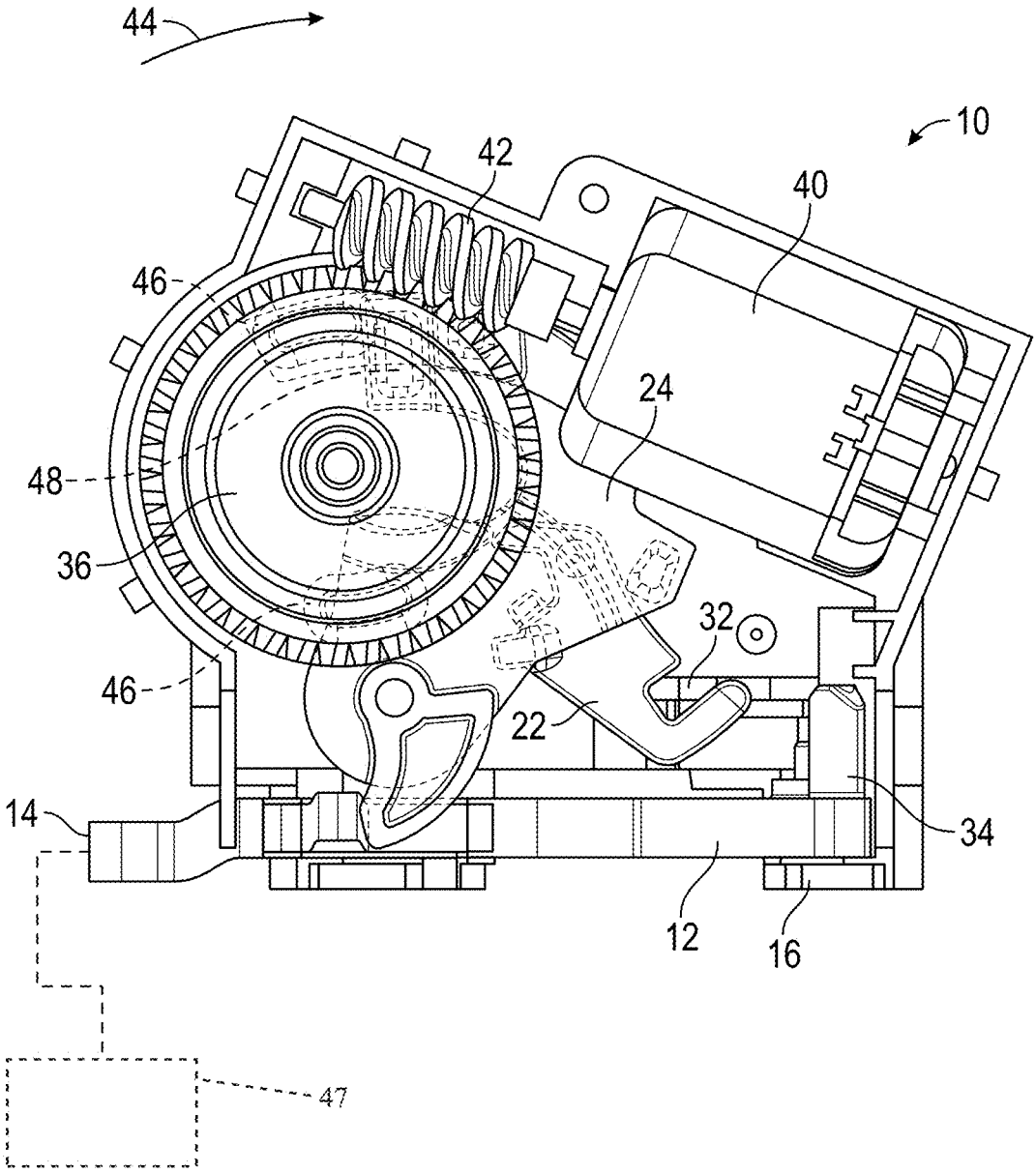
FIG. 2 illustrates movement of the bellcrank of the latch of FIG. 1.
Figure 3:
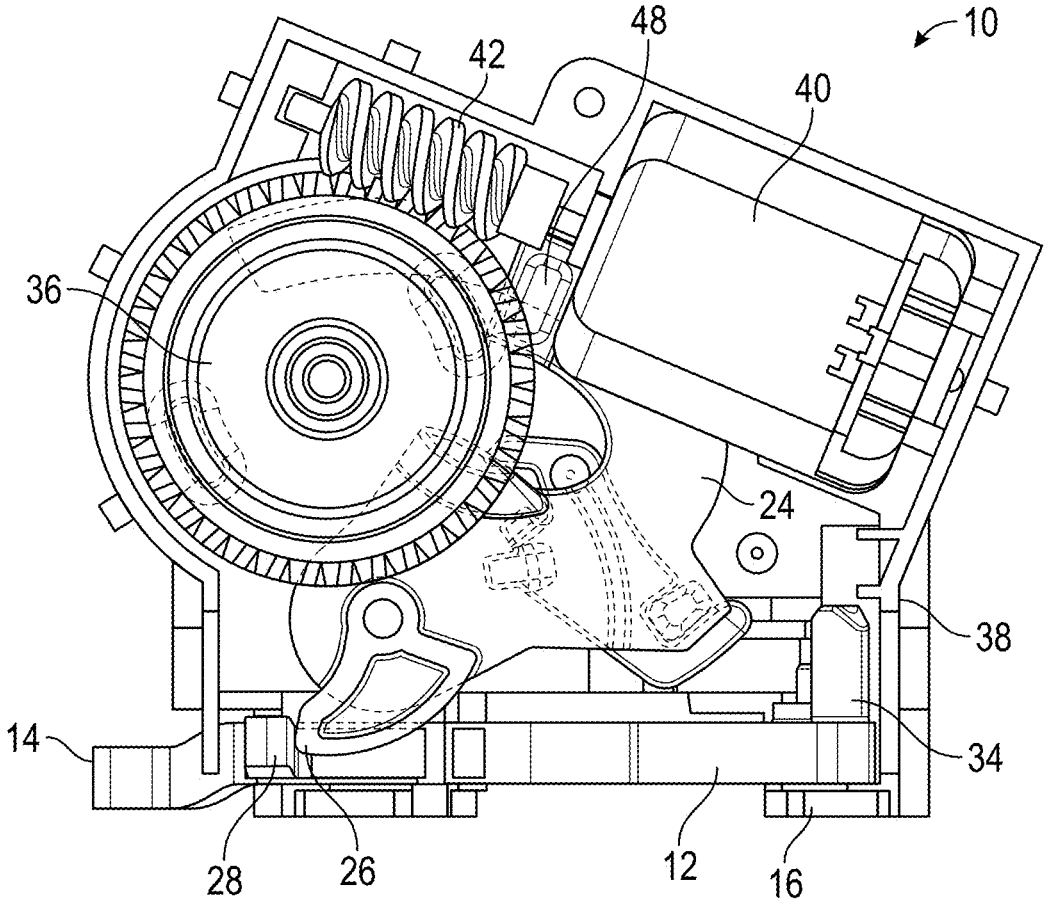
FIGS. 3 and 4 illustrate the bellcrank of the latch of FIG. 1 being engaged by a hold open lever or feature.
Figure 4:
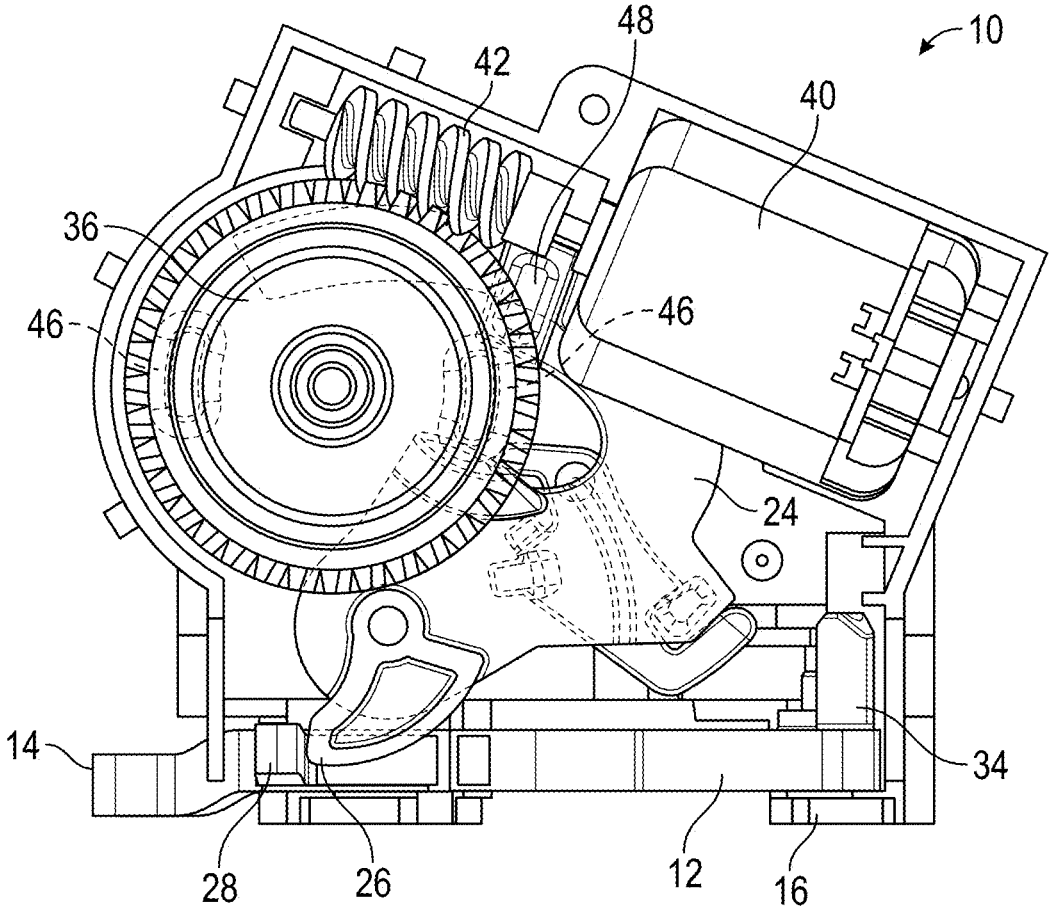
Figure 5:
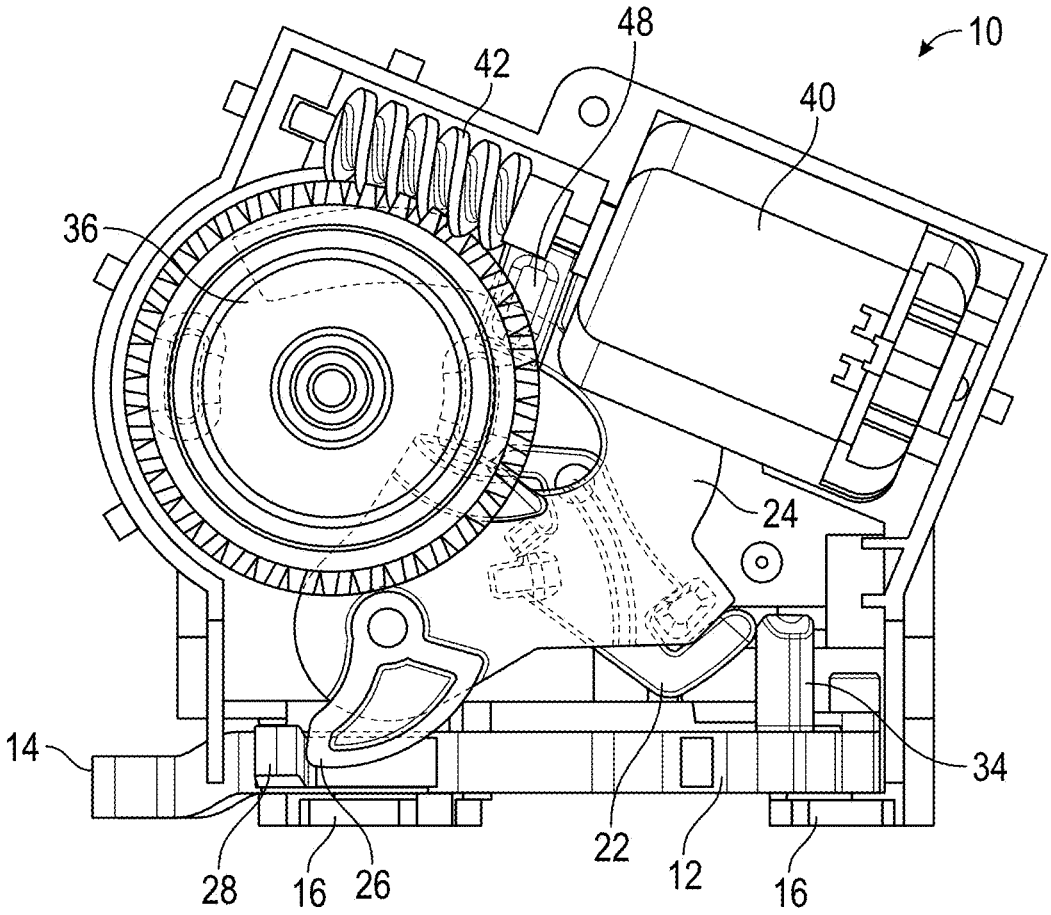
FIGS. 5 and 6 illustrate movement of the fork bolt of the latch from a primary or latched position to an open position.

As mentioned above, it is desirable to provide certain latches with a means for holding the detent lever in a desired position. In particular, one non-limiting design may be incorporated into a rear liftgate latch. This latch with a hold open lever and other components as described herein provides a means for retaining the detent lever in an open position or non-engagement position after it has been power released and the door remains in the closed position due to ice buildup or snow or any other force applied to or around the door. In order to provide this feature, the hold open lever is configured to make sure the detent lever is held in an open or disengaged position after it has been moved from a closed position or engaged position until the desired operation of the latch occurs.

Reference is made to the following U.S. Pat. Nos. 3,969,789; 6,568,741; 6,679,531; 8,348,310 and U.S. Patent Publication Nos. US 2010/0127512; US 2011/0204659; US 2012/0292927 and provisional Patent Application Ser. No. 61/806,530 filed Mar. 29, 2013, the entire contents each of which are incorporated herein by reference thereto.

Referring now to the FIGS. various embodiments of the invention will be described with reference to specific embodiments, without limiting same, the attached FIGS. shows portions of a latch or latch assembly 10.

In the exemplary embodiment shown, latch 10 is a compartment latch. A compartment latch 10 of the type shown is useful for the rear compartment, such as a trunk of a vehicle. The latch 10 can keep the trunk lid latched, can keep a lift gate of a vehicle latched or a sliding door of vehicle closed, such as a van door. Still further the latch 10 can be used with any vehicle door.

However, the latch 10 is applicable to any environment where the features of various embodiments of the invention are desired. For example, the latch assembly can be attached to a vehicle structure such that the fork bolt is moved between the open position and the closed position when a hood, door, window, lift gate, etc. is opened and closed and the fork bolt engages a striker that is attached to the hood, door, window, lift gate, etc.

Alternatively, the latch 10 or latch assembly 10 can be secured to the hood, door, window, lift gate, etc. and the striker is secured to the vehicle body at an opening into which the hood, door, window, lift gate, etc. is received.

Latch 10 is located on a first element or first vehicle component which is either a frame (e.g., body member surrounding or proximate to an opening the movable member covers) or movable member (e.g., door, window, lift gate, hood, etc.) and includes a fork bolt or claw 12 and a detent lever or pawl 14. Each of which may be pivotally or movably mounted to a housing 16 or another portion or housing of the latch 10. In one non-limiting embodiment, the fork bolt 12 is capable of rotation about first stud or pin, while detent lever is a capable of rotation about a second stud or pin. During operation, a striker is attached to a second element or second vehicle component, which is either the frame or movable member depending on which one has the latch 10 secured thereto.

Figure 7:
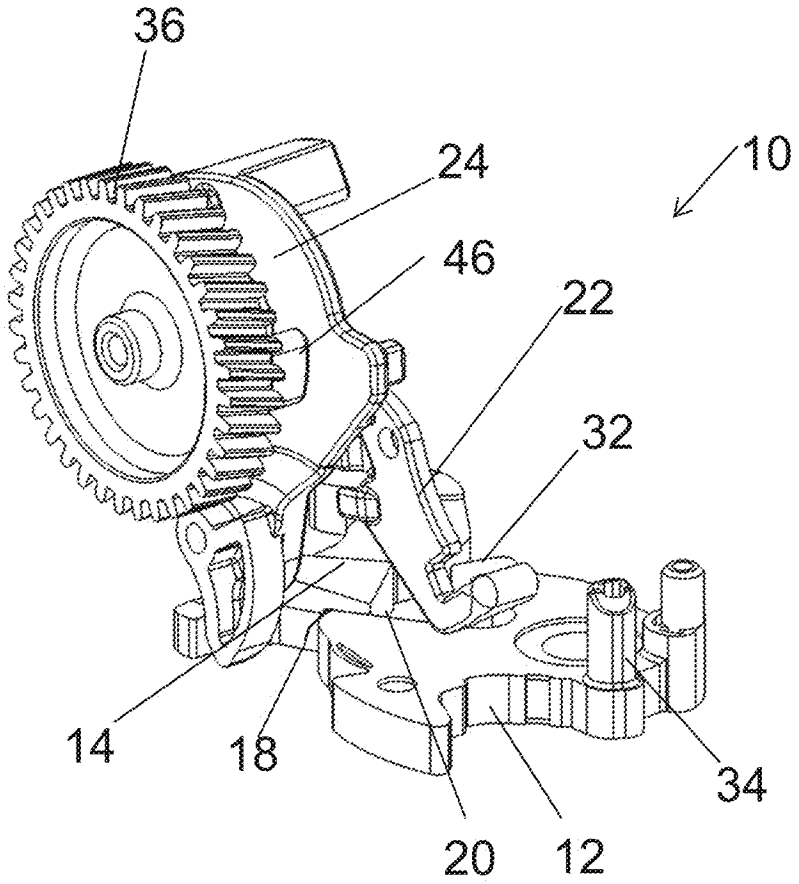
FIG. 7 is perspective view of the latch in FIG. 1 from an opposite side with portions of the latch removed.
Figure 8:
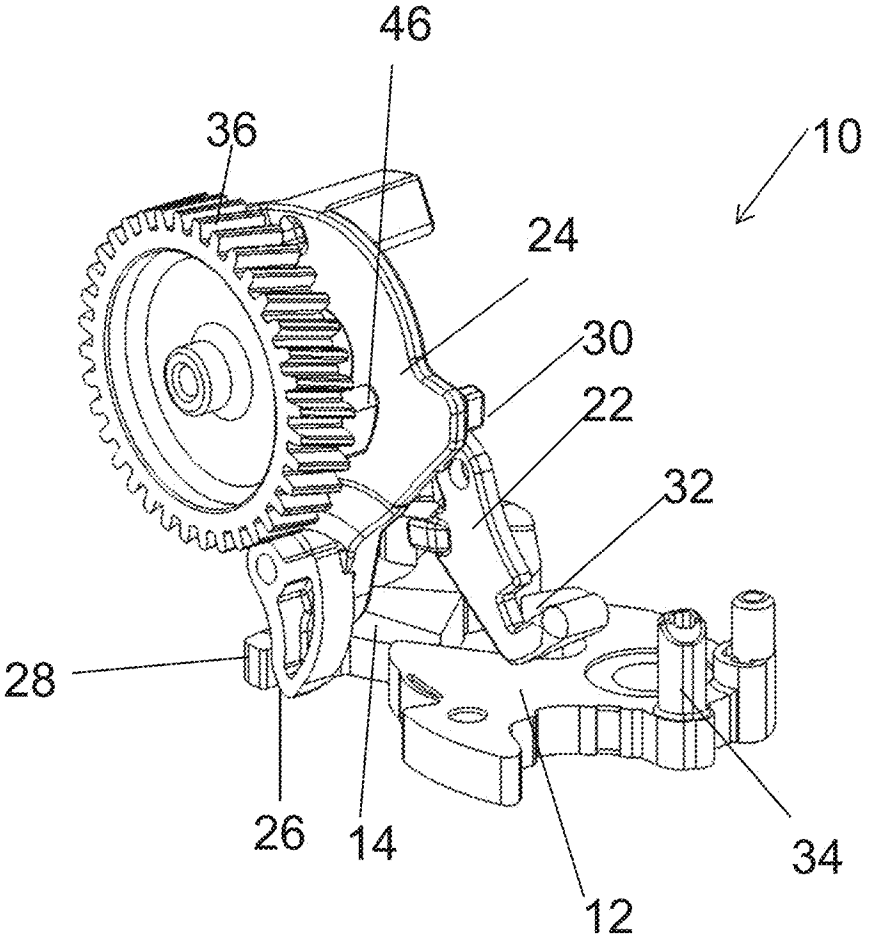
FIG. 8 is perspective view of the latch in FIG. 2 from an opposite side with portions of the latch removed.
Figure 9:
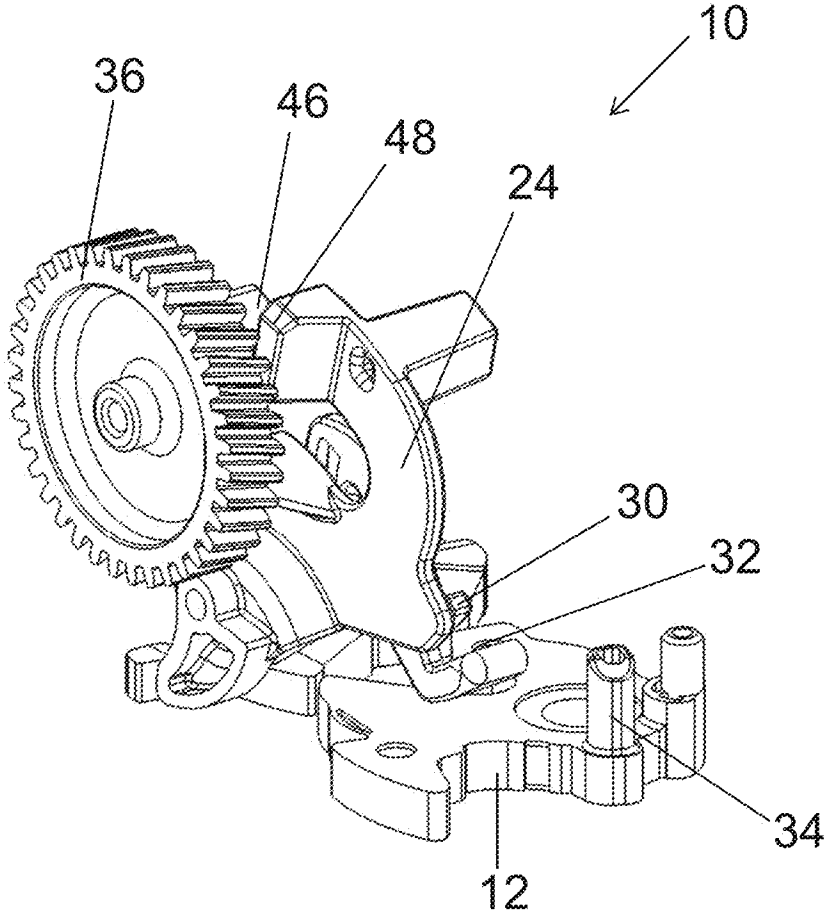
FIG. 9 is perspective view of the latch in FIG. 3 from an opposite side with portions of the latch removed.
Figure 10:
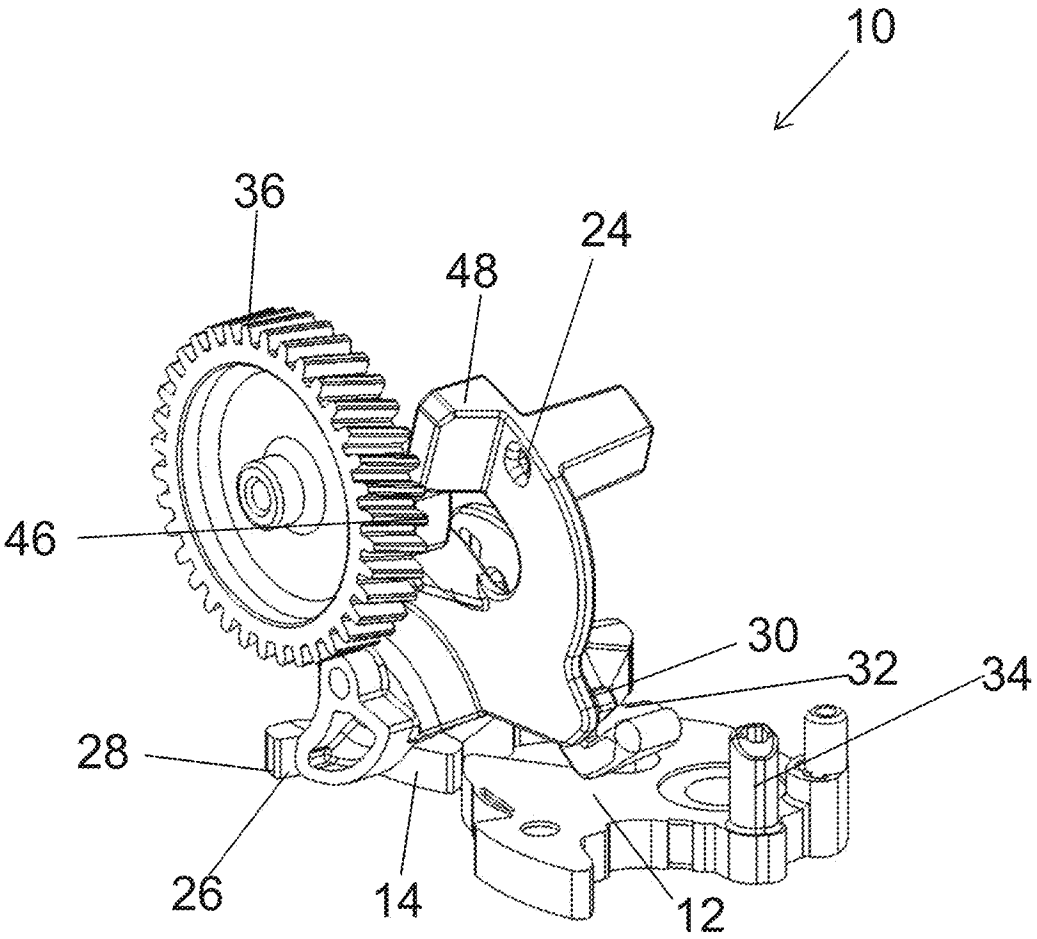
FIG. 10 is perspective view of the latch in FIG. 4 from an opposite side with portions of the latch removed.
Figure 11:
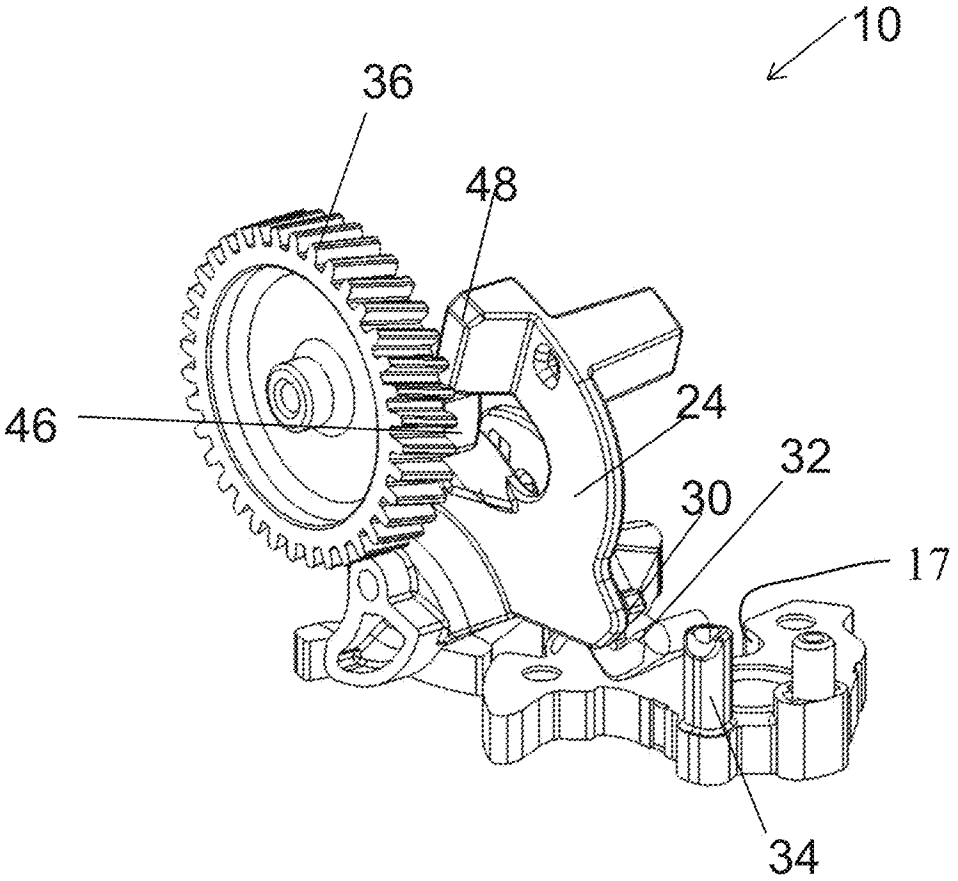
FIG. 11 is perspective view of the latch in FIG. 5 from an opposite side with portions of the latch removed.
Figure 12:
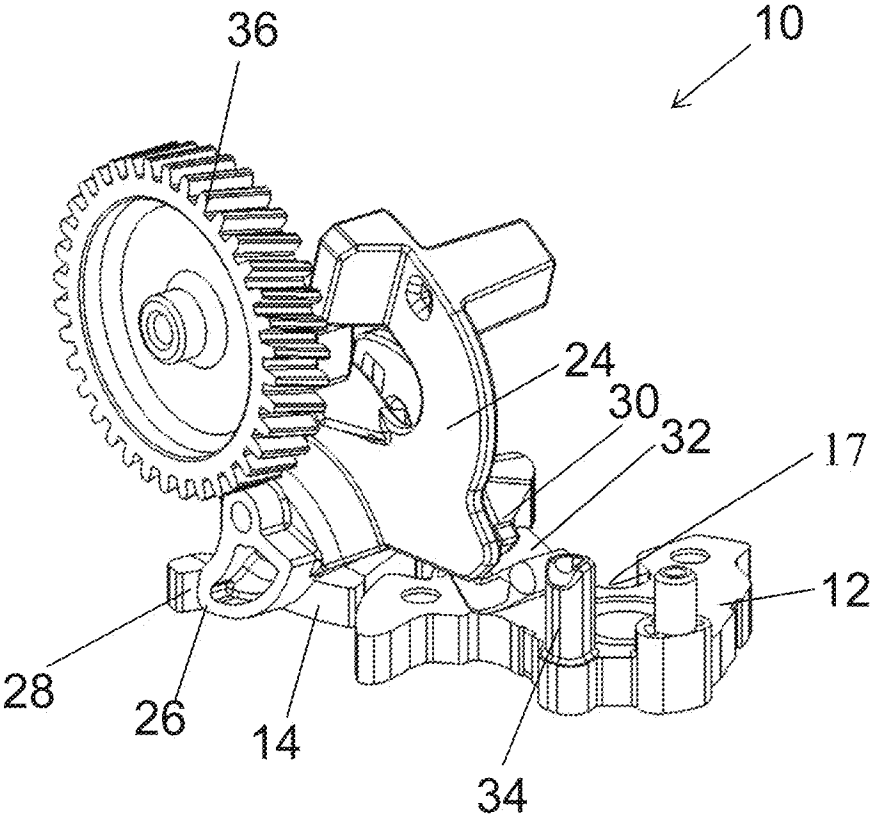
FIGS. 12 and 13 are perspective views illustrating movement of the latch in FIG. 6 from an opposite side with portions of the latch removed.

In accordance with an exemplary embodiment, the fork bolt 12 is capable of movement between a first or latched position or closed position (see at least FIGS. 1 and 8) wherein the striker is engaged by a throat 17 of the fork bolt and a second or open position (see at least FIGS. 7, 12 and 13) wherein the striker is free to be released from the throat 17 of the fork bolt 12. The housing of the latch 10 will also have a complimentary opening for receipt of the striker therein when it is engaged or latched by the fork bolt. In one non-limiting embodiment, the fork bolt 12 may be spring biased into the second or open position by a spring or biasing member.

Alternatively or in addition to the spring biasing force applied to the fork bolt, the movable member may also be spring biased or biased into an open position such that when the latch 10 is released fork bolt 12 will rotate and release striker. One non-limiting example of an item providing such a force is the compressed weather stripping or sealing member located around the periphery of the opening that is covered by the movable member. In other words, when the door is closed, the sealing member is compressed and the latch 10 engages the striker. Thereafter and when the latch 10 is released, the sealing member may provide an urging force to open the door or gate, etc. However and as mentioned above, when a force is applied to the movable member, these biasing forces (spring or otherwise) are not sufficient to move the member into an open position such that the striker is removed from the throat of the fork bolt 12.

During operation and in order to retain the latch 10 or fork bolt 12 in the latched position, the detent lever or pawl 14 is pivotally secured to the latch 10 for movement between an engaged position or latched position (see at least FIGS. 1 and 8) and a disengaged position or released position (see at least FIGS. 3, 4, 9 and 10). When the detent lever 14 is in the engaged position, a surface 18 of the fork bolt 12 is engaged by a surface 20 of the detent lever 14 and the fork bolt 12 is prevented from moving toward the unlatched position from the latched position. In one non-limiting implementation, a first spring may be provided for biasing the fork bolt into the open position while a second spring may be provided for biasing the detent lever in the direction of the engaged position, such that movement of the fork bolt to the latched position will cause the detent lever 14 to move to the engaged position.

Figure 6:
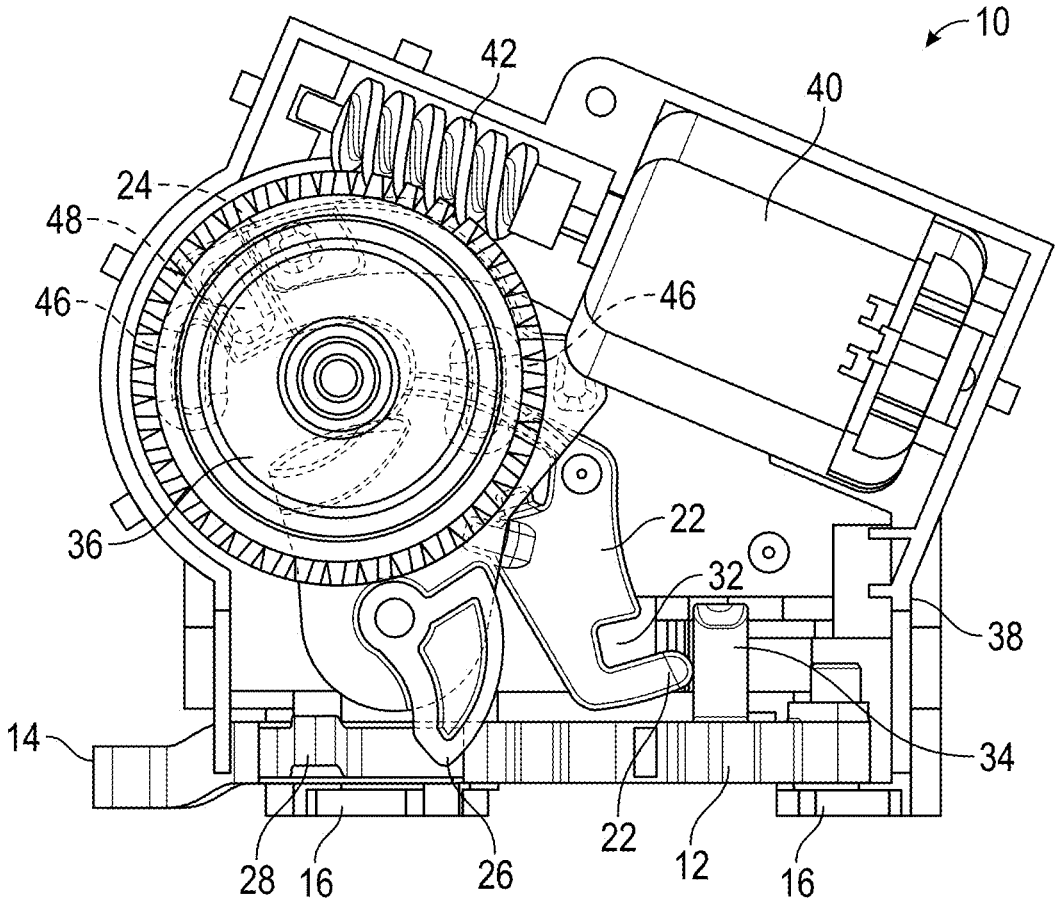
Figure 13:
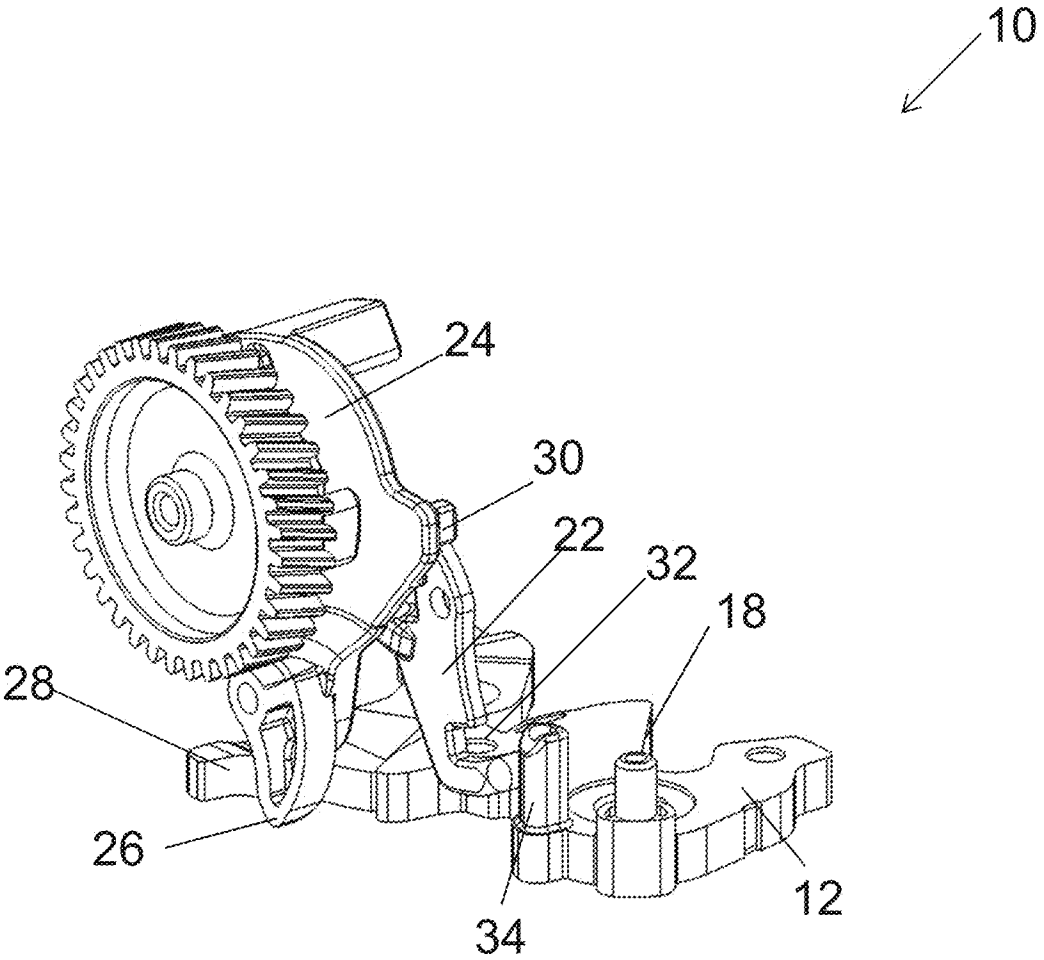

In accordance with exemplary embodiments of the present invention, a hold open feature or lever 22 is movably mounted to the latch 10 for movement between a first position (see at least FIGS. 1-5 and 7-11) and a second position (see at least FIGS. 6 and 13). In addition, the latch 10 further comprises a bellcrank lever 24 also movably mounted to the latch 10 for movement between a first position (see at least FIGS. 1, 2, 6-8 and 13) and a second position (see at least FIGS. 3-5 and 9-11).

As the bellcrank lever 24 moves from the first position to the second position, a contact portion 26 of the bellcrank lever 24 makes contact with a contact portion 28 of the detent lever 14 and moves the detent lever 14 from the engaged position or latched position to the disengaged position or released position. In addition and as the bellcrank lever 24 moves from the first position to the second position, a feature or portion 30 of the bellcrank lever 24 is received and engaged in an opening or receiving area or receiving feature 32 of the hold open feature or hold open lever 22 when the hold open feature or hold open lever is in the first position.

In accordance with an exemplary embodiment, the hold open feature or hold open lever 22 receives and engages a feature or portion 30 of the bellcrank lever 24 when it is in the first position and keeps the bell crank lever in the second position until the hold open lever 22 is moved to the second position. Once the hold open lever 22 is moved to the second position the bellcrank lever 24 can move from its second position to its first position. In one embodiment, the hold open lever 22 may be spring biased into its first position.

In accordance with one non-limiting embodiment, the hold open lever or hold open feature 22 is moved from its first position to its second position by a feature or post 34 positioned on a surface of the fork bolt 12 such that as the fork bolt 12 moves or rotates from the first or primary latched position to the open position the post 34 will contact the hold open lever or hold open feature 22 and move it from its first position to its second position thereby allowing the bellcrank lever 24 to move from its second position to its first position. The movement of the bellcrank lever 24 from its second position to its first position allows the detent lever 14 to move from its second or disengaged position to its first or engaged position.

In one embodiment, the latch 10 further comprises a gear 36 rotatably mounted to an upper housing portion or actuating housing portion 38 of the latch 10. Of course, the gear 36 may be rotatably secured to any other portion of the latch 10 and/or housing of the latch 10. In addition, a motor 40 configured for driving a worm 42 is also located proximate to gear 36 such that motorized rotation of worm 42 causes movement of gear 36 in the direction of arrow 44. Movement of the gear 36 in the direction 44 may be accomplished in one embodiment, by a protrusion 46 of the gear 36, which makes contact with a complementary protrusion 48 of the bellcrank lever 24 in order to move or rotate the bellcrank lever 24 in the direction of arrow 44, which also moves the bellcrank lever 24 from its first position towards its second position.

In one embodiment, the bellcrank lever 24 may be pivotally or movably mounted to upper housing portion 38 so that it may be moved from its first position to its second position. Of course, numerous other locations for the movable or pivotal mounting of the bellcrank lever 24 to the latch 10 are considered to be within the scope of exemplary embodiments of the present invention. In addition, the hold open lever or hold open feature 22 may be pivotally or movably mounted to upper housing portion 38 so that it may be moved from its first position to its second position.

Of course, numerous other locations for the movable or pivotal mounting of the hold open lever 22 to the latch 10 are considered to be within the scope of exemplary embodiments of the present invention. For example and in one embodiment, the hold open lever 22 may be movably mounted to the bellcrank lever 24. Also, gear 36 may be rotationally mounted to the upper housing portion 38, or maybe rotationally mounted to any other suitable location of the latch 10.

In addition and as mentioned above, the fork bolt or claw 12 and the detent lever or pawl 14 may be pivotally or movably mounted to a portion of a housing of the latch, such as a lower portion 16 that is secured to the upper portion 38. However, it is understood that numerous other locations are considered to be within the scope of various exemplary embodiments of the present invention.

One of the features of various exemplary embodiments of the present invention is the disconnection of the bellcrank lever 24 and the detent lever 14 or the ability to disconnect the bellcrank lever 24 from the detent lever 14. In other words and due to the configurations contemplated, the detent lever 14 can be pushed by the bellcrank 24 but it cannot be pulled by it. This phenomenon acts on both components which means that the bellcrank 24 cannot be pulled by the detent lever 14 either.

This configuration eliminates sensitivity of the system to speeds due to the velocity of a striker entering the latch as it may be transmitted to the forkbolt 12 and the detent lever 14 but not to the bellcrank 24 as this component is disconnected in that direction as mentioned above.

One non-limiting advantage of this solution is that it allows the hold open feature 22 to only maintain the detent lever 14 open in the event of a power release (e.g., actuation of motor 40) and not during a manual release. For example and in a manual release, a manual release lever 47 illustrated by the dashed lines in FIG. 1 may act directly on the detent lever 14. Of course, latch 10 can be configured without manual release lever 47.

Figure 14:
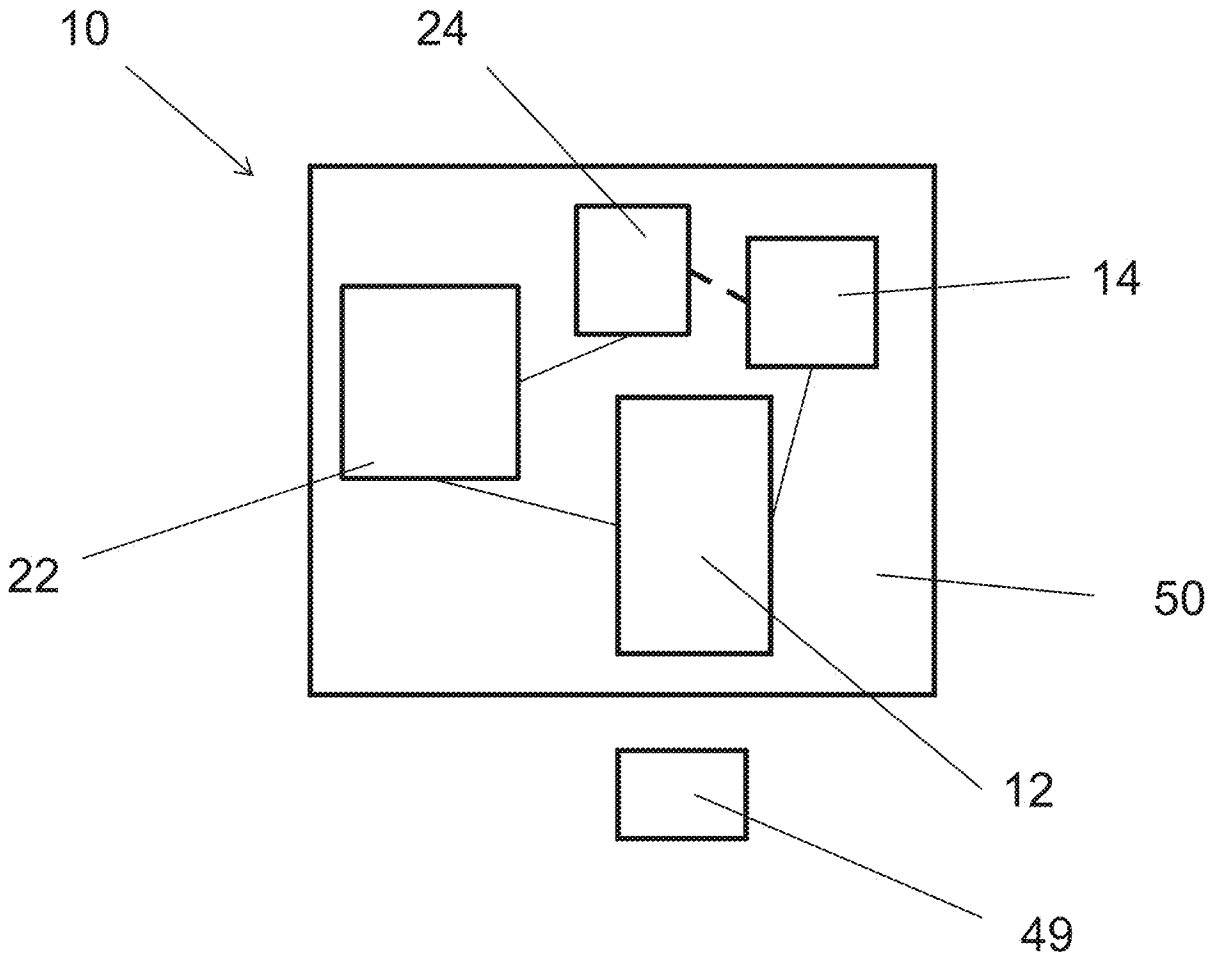
FIG. 14 schematically illustrates a latch according or one non-limiting exemplary embodiment.

FIG. 14 schematically illustrates a latch 10 with a fork bolt 12 and detent lever 14 illustrated schematically. Also shown schematically are the bellcrank 24 and the hold open feature 22. As is known in the related arts, fork bolt 12 is configured to receive, capture and release a striker 49 when it is inserted into an opening of a housing 50 of the latch 10. The dashed lines in FIG. 14 schematically illustrate the disconnection of the bellcrank 24 and the detent lever 14, which in one non-limiting embodiment allows the detent lever 14 to be pushed by the bellcrank 24 but not pulled by it. Similarly, the bellcrank 24 cannot be pulled by the detent lever 14. Thus and in non-limiting exemplary embodiment, forces transmitted to the fork bolt 12 and the detent lever 14 are not transferred to the bell crank 24 and/or its associated hold open feature 22.

Various embodiments of the present invention are contemplated with a rear lift gate latch, and other liftgate latches that utilize a bellcrank and a hold open lever.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

What is claimed is:

1. A latch, comprising:

a housing, a fork bolt movably mounted to the housing for movement between an open position and a closed position, wherein the fork bolt pivots about a first axis;

a detent lever movably mounted to the housing for movement between a latched position and a released position, wherein the detent lever prevents the fork bolt from moving from the closed position to the open position when the detent lever is in the latched position;

a bellcrank lever pivotally mounted to the housing for movement between a first position and a second position, wherein the bellcrank lever contacts and moves the detent lever from the latched position to the released position as the bellcrank lever moves from the first position to the second position, wherein the bellcrank lever pivots about a second axis, wherein the second axis is not parallel to the first axis; and a hold open feature movably mounted to the housing for movement between a first position and a second position, wherein the hold open feature is configured to engage and retain the bellcrank lever in its second position such that the bellcrank lever maintains the detent lever in the released position when the hold open feature is in the first position, and wherein the hold open feature allows the bellcrank lever to travel from the second position to the first position when the hold open feature is in the second position, wherein the latch is configured so that the bellcrank lever cannot be pulled by the detent lever.

2. The latch as in claim 1, wherein the bellcrank lever moves from the first position to the second position when acted upon by a gear.

3. The latch as in claim 1, wherein the bellcrank lever is capable of being disconnected from the detent lever.

4. The latch as in claim 3, wherein the latch is configured so that the detent lever is capable of being pushed by the bellcrank lever.

5. The latch as in claim 4, wherein the latch is configured so that the bellcrank lever is capable of being pushed by the detent.

6. The latch as in claim 3, wherein the latch is configured so that the bellcrank lever is capable of being pushed by the detent lever.

7. The latch as in claim 3, wherein the latch is configured so that force applied to the fork bolt and the detent lever due to a striker entering the housing is not transferred to the bellcrank lever.

8. The latch as in claim 3, wherein the latch is configured so that force applied to the fork bolt and the detent lever due to a striker entering the housing is not transferred to the hold open feature when the bellcrank lever is disconnected from the detent lever.

9. The latch as in claim 1, wherein the latch is configured so that the hold open feature only maintains the detent lever, via the bellcrank lever, in the released position in the event of a power release and not during a manual release as the manual release causes a lever to act directly on the detent lever.

10. The latch as in claim 1, wherein the latch is configured so that the detent lever is capable of being pushed by the bellcrank lever.

11. The latch as in claim 10, wherein the latch is configured so that the bellcrank lever is capable of being pushed by the detent lever.

12. The latch as in claim 1, wherein the latch is configured so that the bellcrank lever is capable of being pushed by the detent lever.

13. The latch as in claim 1, wherein the latch is configured so that force applied to the fork bolt and the detent lever due to a striker entering the housing is not transferred to the bellcrank lever.

14. The latch as in claim 1, wherein the bellcrank lever moves from the first position to the second position when acted upon by a gear movably mounted to the housing and wherein the latch further comprises a motor configured to rotate the gear.

15. The latch as in claim 14, wherein the bellcrank lever is capable of being disconnected from the detent lever.

16. The latch as in claim 15, wherein the bellcrank lever is configured so that the detent lever is capable of being pushed by the bellcrank.

17. The latch as in claim 14, wherein the bellcrank lever is configured so that the bellcrank lever is capable of being pushed by the detent lever.

18. The latch as in claim 17, wherein the bellcrank lever is configured so that the detent lever is capable of being pushed by the bellcrank lever.

19. A method of disengaging a hold open feature from engagement with a detent lever of a latch, comprising:

pivotally mounting a fork bolt to a housing for movement between an open position and a closed position about a first axis;

pivotally mounting the detent lever to the housing for movement between a latched position and a released position, wherein the detent lever engages the fork bolt and prevents the fork bolt from moving from the closed position to the open position when the detent lever is in the latched position;

pivotally mounting a bellcrank lever to the housing for movement between a first position and a second position about a second axis, wherein the bellcrank lever is configured to contact and move the detent lever from the latched position to the released position as it moves from the first position to the second position, wherein the first axis is not parallel to the second axis; and movably mounting the hold open feature to the housing for movement between a first position and a second position, wherein the hold open feature is configured to engage and retain the bellcrank lever in its second position such that the bellcrank lever maintains the detent lever in the released position when the hold open feature is in the first position, and wherein the hold open feature allows the bellcrank lever to travel from the second position to the first position when the hold open feature is in the second position, wherein the latch is configured so that the bellcrank lever cannot be pulled by the detent lever.

20. The method as in claim 19, wherein the hold open feature is moved from the first position to the second position as the fork bolt moves from the closed position to the open position.

* * * * *